US010882734B2

(12) United States Patent
Enderle et al.

(10) Patent No.: US 10,882,734 B2
(45) Date of Patent: Jan. 5, 2021

(54) DEVICE AND METHOD FOR CONVEYING VISCOUS MATERIAL

(71) Applicant: Atlas Copco IAS GmbH, Bretten (DE)

(72) Inventors: Gerrit Enderle, Knittlingen (DE); Thomas Hausner, Bretten (DE)

(73) Assignee: Atlas Copco IAS GmbH, Bretten (DE)

( * ) Notice: Subject to any disclaimer, the term of this patent is extended or adjusted under 35 U.S.C. 154(b) by 0 days.

(21) Appl. No.: 16/475,757

(22) PCT Filed: Dec. 8, 2017

(86) PCT No.: PCT/EP2017/081973
§ 371 (c)(1),
(2) Date: Jul. 3, 2019

(87) PCT Pub. No.: WO2018/130350
PCT Pub. Date: Jul. 19, 2018

(65) Prior Publication Data

US 2019/0322521 A1 Oct. 24, 2019

(30) Foreign Application Priority Data

Jan. 16, 2017 (DE) ..... 10 2017 100 712

(51) Int. Cl.
*B67D 7/02* (2010.01)
*B67D 7/64* (2010.01)
(Continued)

(52) U.S. Cl.
CPC ..... *B67D 7/645* (2013.01); *B05C 11/10* (2013.01); *B05C 11/11* (2013.01); *B67D 7/02* (2013.01);
(Continued)

(58) Field of Classification Search
CPC ..... B67D 7/645; B67D 7/0227; B67D 7/02; B05C 11/10; B05C 11/11; F04B 15/02; F04B 23/028
See application file for complete search history.

(56) References Cited

U.S. PATENT DOCUMENTS 2,341,128 A 2/1944 Titus et al.
2,630,248 A 3/1953 Hinz
(Continued)

FOREIGN PATENT DOCUMENTS

CN 1759064 A 4/2006
CN 101535148 A 9/2009
(Continued)

OTHER PUBLICATIONS

English translation of the International Preliminary Report on Patentability and Written Opinion of the International Searching Authority in PCT/EP2017/081973, dated Jul. 25, 2019.
(Continued)

*Primary Examiner* — Frederick C Nicolas
(74) *Attorney, Agent, or Firm* — Collard & Roe, P.C.

(57) ABSTRACT

An apparatus for conveying viscous material from a drum-like container with a container bottom and a circumferential container wall extending from the container bottom to a container upper side and being open at the container upper side has, for closing the container a follower plate having a material outlet attached to a conveyor pump. The follower plate has an annularly circumferential wiper ring that has a radially outwardly extending contacting part for contact against an inside face, turned toward the follower plate, of the container wall. The contacting part can be pressurized with a variable pressing force for pressing against the inside face (36) of the container wall. The follower plate is mounted by moans of at least one vertically extending retaining rod on a horizontally extending crosspiece
(Continued)

Fig.4 mounted on or close to a first end on a lifting device for raising and lowering of the crosspiece. Its second end is free. This task is accomplished by an apparatus having the features according to one aspect of the invention as well as by a method having the features according to another aspect of the invention. Advantageous further developments of the invention are subject matter discussed below.

24 Claims, 4 Drawing Sheets

(51) Int. Cl.
*B05C 11/10* (2006.01)
*B05C 11/11* (2006.01)
*F04B 15/02* (2006.01)
*F04B 23/02* (2006.01)

(52) U.S. Cl.
CPC ..... *B67D 7/0227* (2013.01); *F04B 15/02* (2013.01); *F04B 23/028* (2013.01)

(56) References Cited

U.S. PATENT DOCUMENTS 3,031,106 A 4/1962 Hooker
3,895,745 A * 7/1975 Hook ..... B65G 53/4633 222/368
3,976,229 A * 8/1976 Jackson ..... B29B 13/022 222/146.5
3,982,669 A * 9/1976 Moore ..... B29B 13/022 222/146.5
4,073,409 A * 2/1978 Gardner ..... F04B 23/023 222/146.5
4,195,755 A * 4/1980 Slautterback ..... B29B 13/022 219/230
4,632,281 A * 12/1986 Wold ..... B05C 21/00 220/226
4,651,897 A * 3/1987 Johnson ..... B67D 7/645 222/261
4,661,688 A 4/1987 Gabryszewski
4,790,456 A * 12/1988 Nakane ..... B67D 7/62 222/183
5,257,723 A * 11/1993 Bagung ..... B67D 7/0227 222/1
6,003,732 A * 12/1999 Farley ..... B67D 7/0227 222/146.5
6,082,888 A 7/2000 Sakayori
6,131,766 A * 10/2000 King ..... B67B 7/26 222/1
6,457,356 B1 * 10/2002 Meloche ..... B67D 7/0227 222/262
6,860,696 B2 * 3/2005 Bazan ..... B67D 7/0227 414/403
7,762,428 B2 * 7/2010 Scheugenpflug ..... B05C 11/10 222/53
8,544,699 B2 * 10/2013 Quam ..... F04F 1/06 222/261
10,486,958 B1 * 11/2019 Hryckowian ..... B67D 7/02
2001/0025864 A1 * 10/2001 Meyer ..... B67D 7/0227 222/261
2008/0023082 A1 1/2008 Schucker
2008/0067192 A1 3/2008 Stanton et al.
2011/0171042 A1 7/2011 Quam
2016/0002025 A1 1/2016 Waizenauer et al.
2016/0016785 A1 1/2016 Tartler
2018/0339896 A1 11/2018 Tartler
2019/0210865 A1 * 7/2019 Hausner ..... B05C 11/10
2019/0314858 A1 * 10/2019 Tasaka ..... F04B 15/02
2019/0367352 A1 * 12/2019 Hausner ..... B67D 7/645
2020/0017353 A1 * 1/2020 Tartler ..... B67D 7/645
2020/0018299 A1 * 1/2020 Mori ..... B05C 11/10
2020/0063726 A1 * 2/2020 Enderle ..... F04B 15/02

FOREIGN PATENT DOCUMENTS

CN 102954225 A 3/2013
CN 105377745 A 3/2016
DE 91 01 116 U1 6/1991
DE 44 19 536 A1 12/1995
DE 201 02 413 U1 5/2001
DE 197 13 938 C2 4/2003
DE 20 2004 009 185 U1 10/2005
DE 10 2004 030 654 A1 1/2006
DE 198 47 031 B4 2/2008
DE 20 2011 108 222 U1 2/2012
DE 20 2013 009 164 U1 11/2013
EP 0 943 583 A1 9/1999
EP 2 801 462 A1 11/2014
FR 2 409 938 A1 6/1979

OTHER PUBLICATIONS

International Search Report in PCT/EP2017/081973, dated Apr. 19, 2018.
German Office Action in DE 10 2017 100 712.1, dated Sep. 18, 2017, with English translation of relevant parts.
International Search Report in PCT/EP2017/070672, dated Dec. 14, 2017.
German Office Action in DE 10 2016 010 622.0, dated Dec. 15, 2016, with English translation of relevant parts.
English translation of the International Preliminary Report on Patentability and Written Opinion of International Searching Authority in PCT/EP2017/070672, dated Mar. 14, 2019.
Chinese Office Action dated Jul. 22, 2020 in Chinese Application No. 201780053973.3, with Engish translation.

* cited by examiner

DEVICE AND METHOD FOR CONVEYING VISCOUS MATERIAL

CROSS REFERENCE TO RELATED APPLICATIONS

This application is the National Stage of PCT/EP2017/081973 filed on Dec. 8, 2017, which claims priority under 35 U.S.C. § 119 of German Application No. 10 2017 100 712.1 filed on Jan. 16, 2017, the disclosure of which is incorporated by reference. The international application under PCT article 21(2) was not published in English.

BACKGROUND OF THE INVENTION

1. Field of the Invention

The invention relates to an apparatus for the conveying of viscous material as well as to a method for the conveying of viscous material, in which such an apparatus is used.

2. Description of the Related Art

An apparatus that is used for the conveying of viscous material, especially of adhesives, sealing compounds or insulating compounds, from a drum to a processing station, is described in DE 10 2004 030 654 A1. Such apparatuses find use in particular in the automotive industry, when viscous materials must be applied onto vehicle body parts. The follower plate rests on the surface of the material present in the drum and follows this surface when the material level descends. The material is withdrawn from the drum by a conveyor pump, wherein the follower plate is slaved to the material surface. In this connection, it is also possible that the follower plate additionally presses on the material surface so that, by virtue of this pressure, the material is pressed into the material outlet. In the process, the wiper ring bears on the inside face of the container wall and, on the one hand, seals off the interior of the drum from the surroundings. On the other hand, during the descent of the follower plate, it wipes off material adhering to the inside face of the drum wall. Once the drum has been emptied, it must be replaced by a new, full drum. For this purpose, the follower plate must be moved upward out of the drum. In order that the follower plate can be moved upward in the drum, the interior of the drum must be ventilated, since otherwise a vacuum that prevents an extraction movement of the follower plate would be developed in the drum. In already known apparatuses, this is accomplished in that compressed air is injected into the drum through a ventilation opening in the follower plate. Since the follower plate has a large area, an overpressure in the drum exerts a large force on the follower plate. Thus some effort is required to control the upward movement of the follower plate.

From DE 201 02 413 U1, an apparatus of the type mentioned in the introduction is known in which the follower plate is provided with a wiper ring that may be varied in its size by means of injection of compressed gas, so that the follower plate is suitable for containers of different diameter. The follower plate illustrated there is designed as a heatable melting plate, which is used to melt the material in the container for the purpose of liquefaction.

It is common to the already known apparatuses that the wiper ring bears sealingly on the inside face of the container wall during introduction of the follower plate into a new, filled container, so that the follower plate must be introduced into the container with very high precision, wherein large forces must be applied for overcoming of the frictional force. For this reason, a horizontally extending crosspiece, on which the follower plate is suspended by means of one or more retaining rods and which is mounted at each of its ends on a lifting device, is provided respectively in the already known apparatuses. This symmetric construction is necessary in order to ensure the necessary precision and force for introduction of the follower plate into the container. Since such conveyor apparatuses in a factory building are usually installed on a building wall and an access from the front must be possible for operator-control personnel, the lifting devices carrying the crosspiece are situated almost exclusively to the left and right of the container. This restricts the handling capability.

It is therefore the task of the invention to further develop an apparatus of the type mentioned in the introduction to the effect that it permits an easier handling. In addition, a method is to be provided with which the follower plate can be removed from the drum in simple manner.

This task is accomplished according to the invention by an apparatus having the features according to one aspect of claim 1 the invention as well as by a method having the features according to another aspect of claim 23 the invention. Advantageous further developments of the invention are subject matter of the dependent claims discussed below.

SUMMARY OF THE INVENTION

The invention is based on the idea of varying the sealing effect of the wiper ring selectively, in order, on the one hand, to achieve a good sealing effect when the drum or the container is at least partly filled with viscous material and to prevent the penetration of air into the container, and, on the other hand, to nullify the sealing effect and thus also the frictional force between the follower plate and the container completely or partly when the follower plate is being introduced into the container or removed from the emptied container. For this purpose, a radially outwardly extending contacting part of the wiper ring, designed for contact against the inside face of the container wall, can be pressurized with a variable pressing force for pressing against the inside face. The pressing force is variable in the sense that it is able to assume at least two different values, wherein a sealing effect is achieved with the one value and no or only a small sealing effect is achieved with the other value. In addition, the pressing force may be variable discretely or continuously between these extreme values. Due to the variation, according to the invention, of the pressing force with which the contacting part is pressed against the inside face of the container wall, it is possible not only to vary the sealing effect of the wiper ring. It is also possible, for introduction of the follower plate into the container and for removal of the follower plate from the container, to reduce the frictional force occurring between the wiper ring and the container wall by reduction of the pressing force, whereby the removal of the follower plate from the container is further facilitated. Since, during extraction of the follower plate from the container, and especially during introduction of the follower plate into the container, no such high frictional force as in already known apparatuses must be overcome, it is possible to fasten the horizontally extending crosspiece, on which the follower plate is suspended, only at one of its ends on a lifting device, while the other end is free. Thus a lifting device must be disposed only on one side of the container, and then it may be positioned directly on the building wall when the conveyor apparatus according to the invention is installed on a building wall. The container and the follower plate are then freely accessible from the front, from the left and from the right, i.e. from all three possible sides, thus facilitating the handling. In addition, less installation space is needed for the conveyor apparatus and one lifting device is obviated, so that the conveyor apparatus according to the invention can be fabricated more favorably and transported more easily.

The lifting device expediently has at least one guide rod that is connected in fixed manner to the crosspiece and is linearly movable in a guide in vertical direction as well as a drive unit for raising and lowering of the crosspiece. The drive unit is able to act on the crosspiece, on the guide rod or guide rods or on a structural part connecting the crosspiece to the guide rod or to the guide rods. For this purpose, it is preferred that each guide rod be linearly movable in a tubular guide and have a first guide element bearing on an inside face of the guide at or close to a lower end, while the guide has a positionally fixed second guide element bearing on an outside face of the guide rod at or close to an upper end. By means of the two guide elements, which are disposed at the largest possible spacing relative to one another, the respective guide rod is guided particularly precisely. According to an advantageous embodiment, a spindle drive for raising and lowering of the crosspiece is provided that is preferably driven by an electric motor.

According to an advantageous further development of the invention, a transport device is provided for transporting of the container in a direction perpendicular to the longitudinal extent of the crosspiece. This transport device is used in particular when the lifting device is installed on a building wall and the crosspiece extends away from the building wall in its longitudinal extent oriented from the lifting device toward the free end. Then it is possible for the transport device to transport the container parallel to the extent of the building wall up to the follower plate and to transport the emptied container away from the follower plate. According to a preferred configuration, the transport device has a roller track, on which the container is installed.

According to another advantageous further development of the invention, the conveyor apparatus has a housing that annularly surrounds the container and the follower plate and is provided with at least one door. The housing increases especially the safety of the operator-control personnel during introduction of the follower plate into the container. Especially when the upper rim of the container and the follower plate are annularly surrounded by the housing, operator-control personnel cannot reach into this region, in which the danger of crushing, especially of the fingers, exists between the follower plate and the container. Above all when the conveyor apparatus is provided with a transport device for transporting of the container in the direction perpendicular to the longitudinal extent of the crosspiece, it is of advantage when the housing is provided with two doors, through which the container can be transported into the housing and out of the housing by means of the transport device. The doors are then disposed expediently on sides of the housing facing away from one another. In addition, it is possible to equip the conveyor apparatus according to the invention with a control device, with which the container is automatically positioned underneath the follower plate by means of the transport device, with which the follower plate is automatically introduced into the container, with which the follower plate, after the emptying of the container, is automatically removed from this, and with which the emptied container is automatically transported away by means of the transport device.

In order to eliminate the frictional force between the wiper ring and the container wall, it may be provided that the contacting part can be retracted from the inside of the container wall by reduction of the pressing force. The pressing force is then zero. The follower plate may then be removed from the container, wherein the wiper ring ideally does not touch the container wall.

The variation of the pressing force may be accomplished in different ways. However, it is preferred that the wiper ring be hollow and have an outer wall enclosing a cavity that is at least partly annularly circumferential and that can be filled with a pressurized medium. Expediently, the outer wall is thicker in the region of the contacting part than in its other regions. In addition, a device is advantageously provided with which the pressurized medium, for example a liquid such as oil, but preferably a gas and especially air, can be injected into the cavity or discharged from it. If pressure is admitted to the cavity, the wiper ring expands and the pressing force with which the contacting part is forced against the container wall is increased. When the outer wall is thicker in the region of the contacting part, more material is available there, and so the sealing effect is improved. In a simple and effective configuration, the contacting part is movable between a sealed position and a released position by pressurizing the cavity with two predetermined different pressures by means, for example, of an inflation and deflation device. In the sealed position, it bears sealingly on the inside face of the container wall, whereas, in the released position, the sealing effect with the inside face of the container wall is nullified.

The follower plate may be provided with a wiper ring. For improvement of the sealing and wiping effect, it is advantageously possible to provide at least one further wiper ring, which is structurally identical to the wiper ring and is disposed parallel to and at a spacing from this.

Most conveyor pumps have a conveyor cylinder and a conveyor piston capable of moving forward and back in the conveyor cylinder. In this connection, it has been discovered by the Applicant that the speed of the conveyor piston during the conveying process may vary in a manner dependent on the material consistency. The Applicant has found by experiments that the speed of the conveyor piston during the delivery stroke is constant at least within a tolerance range provided the material consistency remains constant. If the material being conveyed contains air bubbles, this leads to a significant change of the speed of the conveyor piston during the delivery stroke. On the basis of this knowledge, it is proposed, according to an advantageous further development of the invention, that the speed of the conveyor piston during the delivery stroke be measured by means of a measuring device, so that a change of material consistency and especially the presence of air bubbles may be inferred from a change of the measured speed, so that appropriate measures may be initiated. In particular, by means of an automatic controller, which may be integrated in the control device already mentioned above or implemented by a separate control unit, it is possible, after the replacement of the emptied container by the filled container, to convey material via a waste line into a waste container until the measured speed of the conveyor piston lies in a predetermined tolerance range around a predetermined target speed. Even in the further conveying process, the material being conveyed may be checked for the presence of air bubbles by measurement of the speed of the conveyor piston during the delivery stroke.

BRIEF DESCRIPTION OF THE DRAWINGS

The invention will be explained in more detail in the following on the basis of an exemplary embodiment illustrated schematically in the drawing, wherein.

DETAILED DESCRIPTION OF THE PREFERRED EMBODIMENTS

Figure 1:
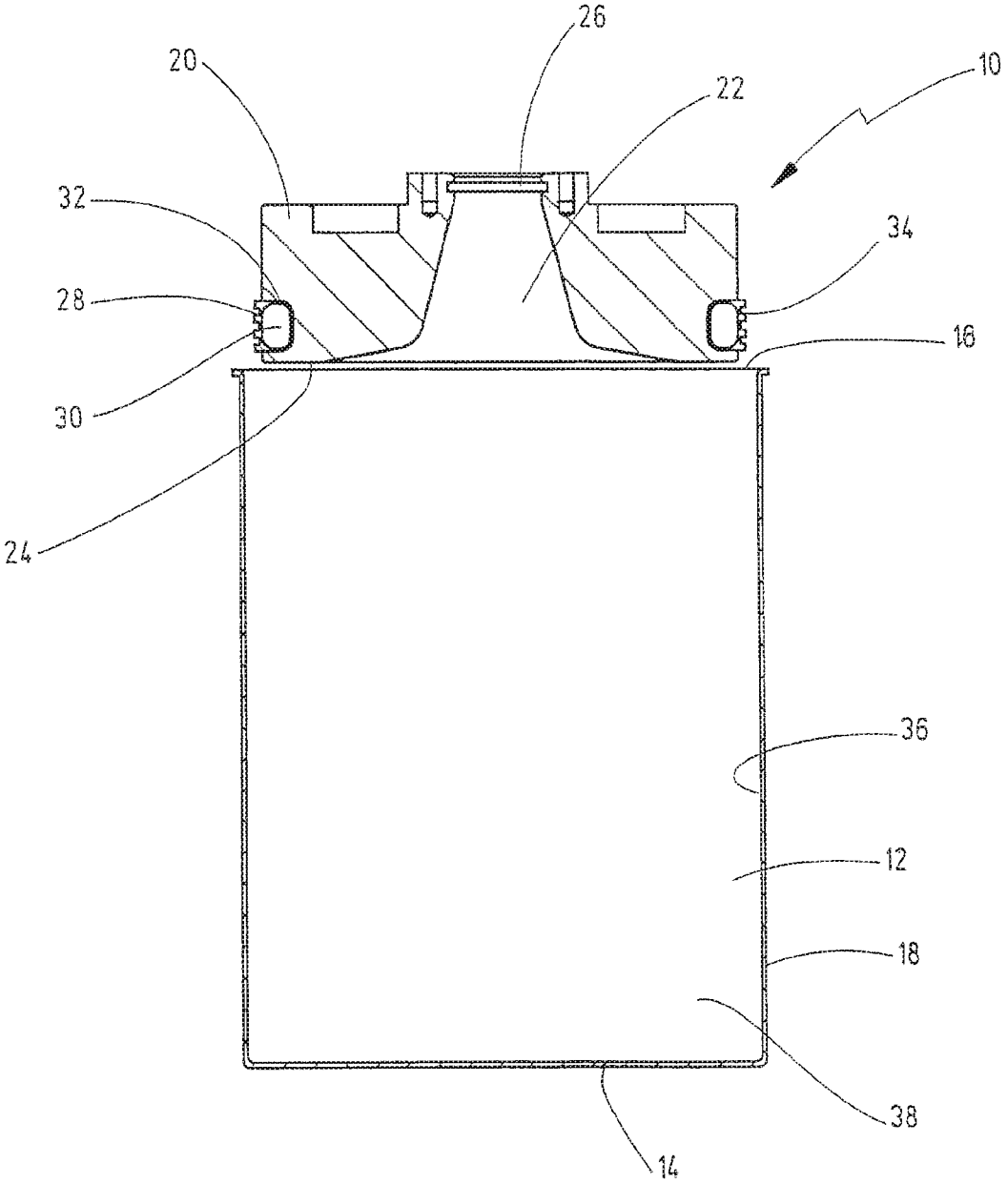
FIG. 1 shows a schematic sectional diagram of parts of an apparatus for the conveying of viscous material having a follower plate prior to its introduction into a container.

The apparatus 10 illustrated schematically in the drawing is used for the conveying of viscous material such as adhesive, sealing compound or insulating compound from a drum-like container 12. This conveyor apparatus 10 is not illustrated in all details in FIGS. 1 to 3, but is reduced to the components essential for understanding of the sealing of the container 12. The container 12 has substantially a cylindrical shape with a container bottom 14 and a container wall 18 that extends upward from the container bottom 14 to a container upper side 16 and is annularly circumferential. The container 12 is open at the container upper side 16.

The conveyor apparatus 10 has a follower plate 20, which for the conveying of the material is introduced into the container 12 and rests there on the material surface. The follower plate 20 may be moved up and down by means of a lifting device, not illustrated in FIGS. 1 to 3. In the middle, it has a dome 22, which extends upward from an underside 24 resting on the material and discharges into a material outlet 26. From the material outlet 26, the material is conveyed by means of a conveyor pump, likewise not illustrated in FIGS. 1 to 3, via a conveyor line to the point of use. In order to largely prevent the inclusion of air, it is also possible to construct the follower plate 20 without dome 22, i.e. with a plane underside, into which the material outlet 26 leads.

Figure 2B:
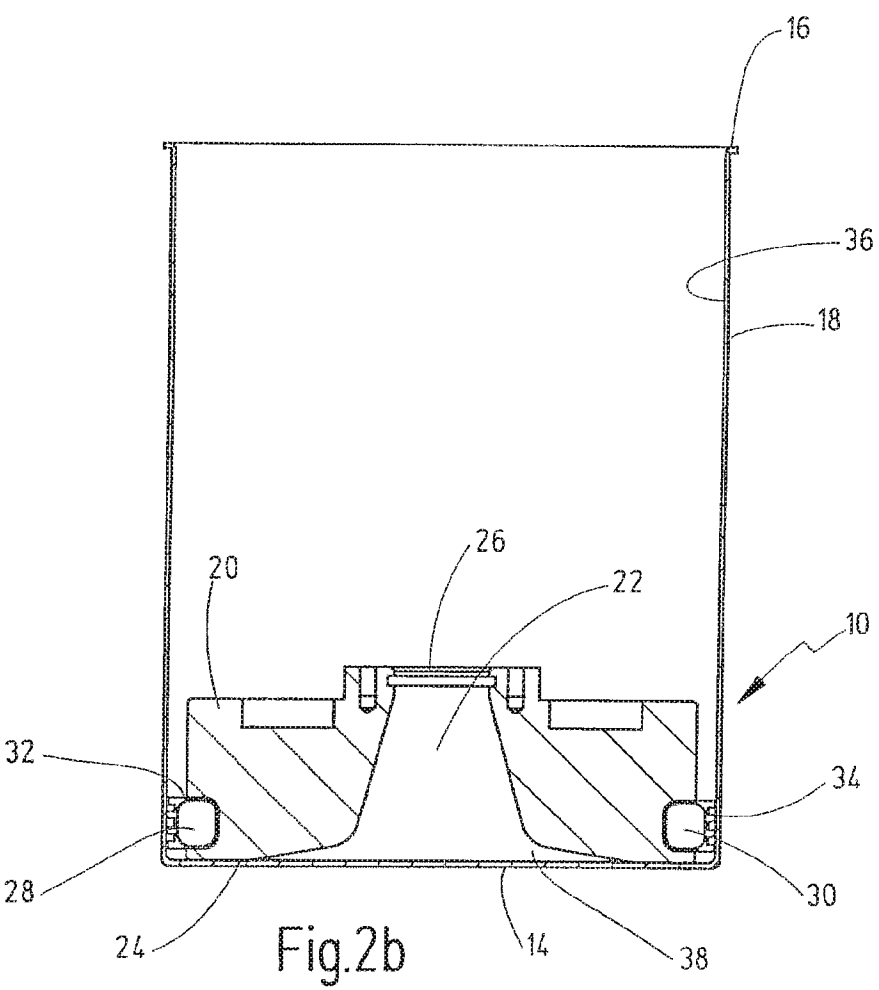
FIGS. 2*a*, 2*b* show the diagram according to FIG. 1 with a follower plate introduced into the container at the beginning and at the end of the conveying process

The follower plate 20 is provided with an annularly circumferential wiper ring 28 of elastically expandable material, in the present case of rubber, which is formed in tubular manner, with an outer wall 32 enclosing an annular cavity 30. In its radially outwardly pointing and outwardly protruding region, the outer wall 32 is thickened with formation of a contacting part 34, which is designed for sealing contact against an inside face 36 of the container wall 18. When a pressurized medium is injected into the cavity 30, it is pressurized with compressed air, for example by means of an inflating and deflating device, not illustrated, the wiper ring 28 expands and the contacting part 34 is moved radially outward. Once the follower plate 20 has been introduced into the container 12, the contacting part is moved into a sealed position in which, as shown in FIGS. 2*a*, 2*b*, it is pressed by the force exerted by the compressed air in the cavity 30 against the inside face 36 and seals the container interior space 38 situated under the follower plate 20 from the surroundings.

Figure 2A:
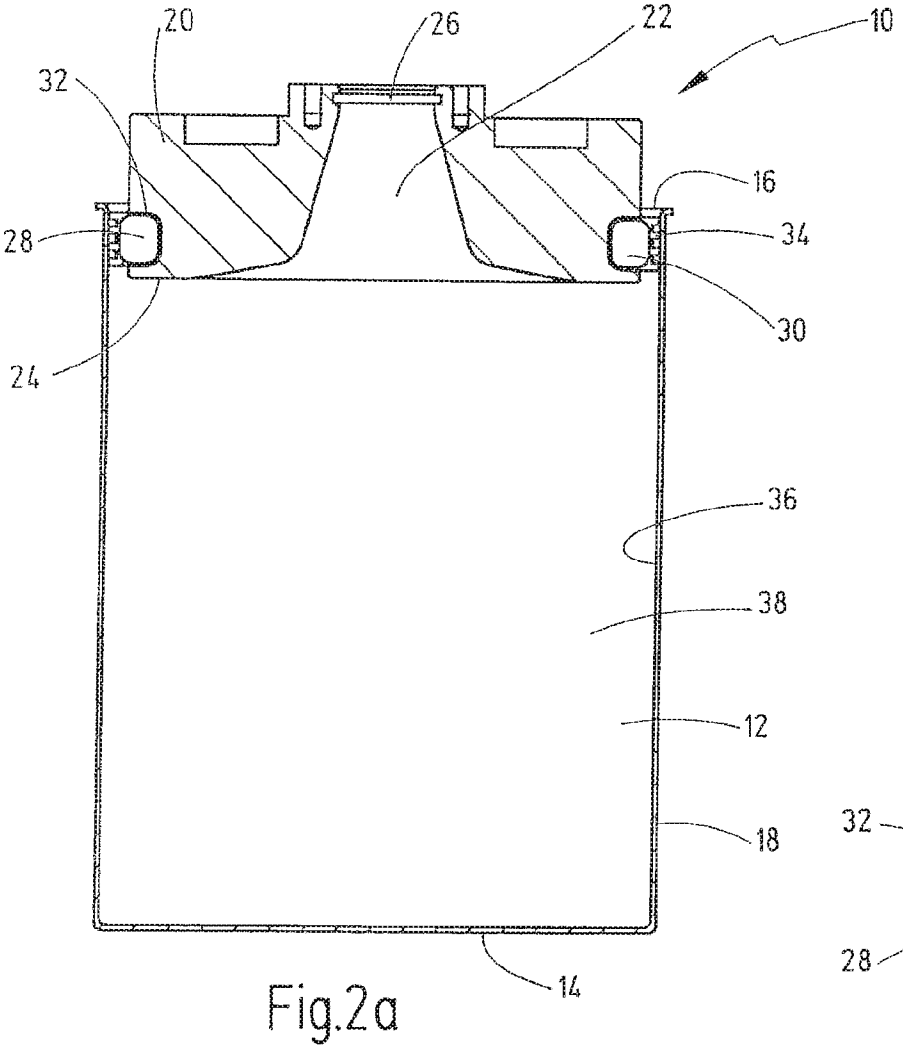
Figure 3B:
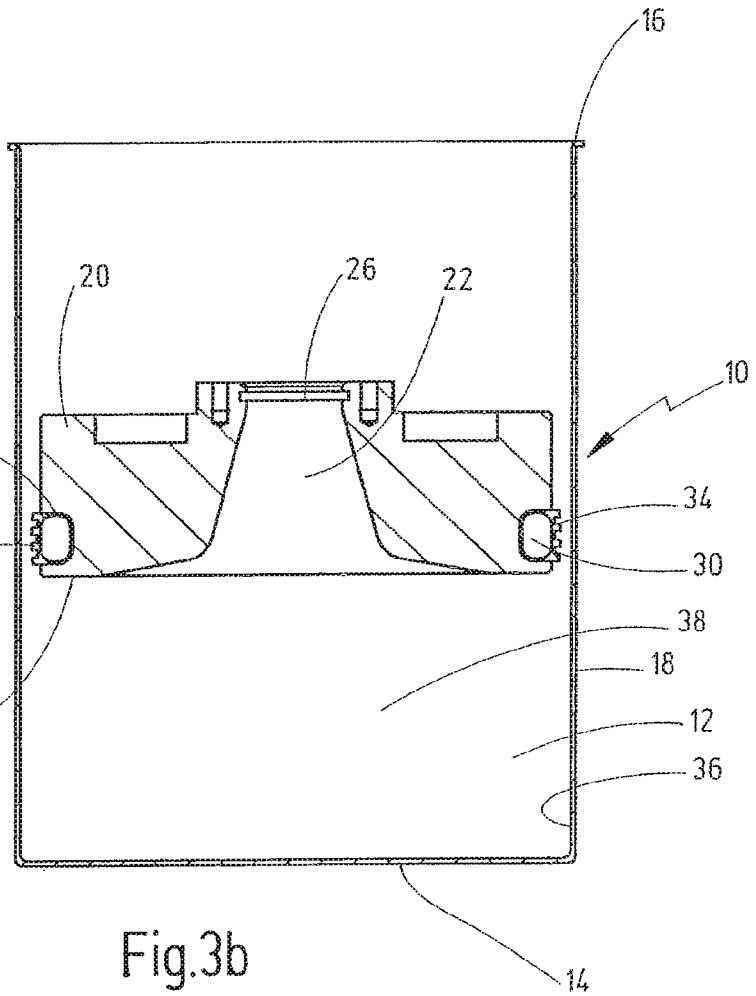
FIGS. 3*a*, 3*b* show the diagram according to FIG. 1 with a follower plate present in the container in two different positions after the end of the conveying process
Figure 3A:
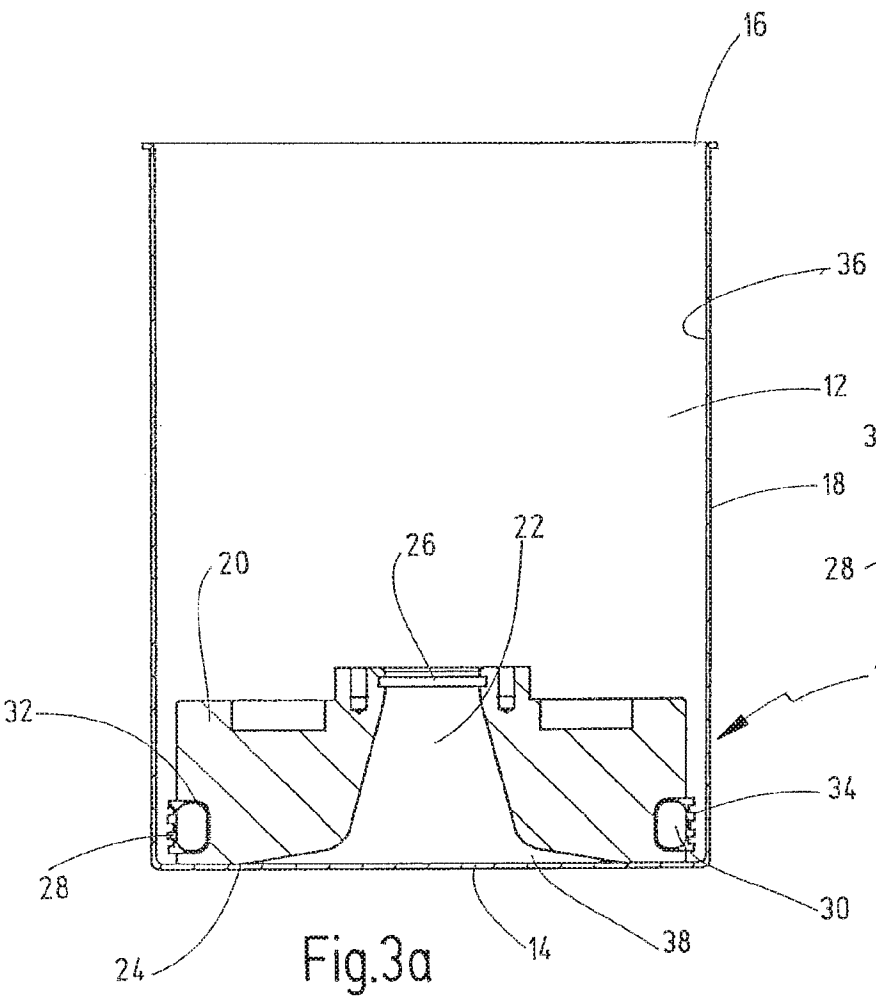
Figure 4:
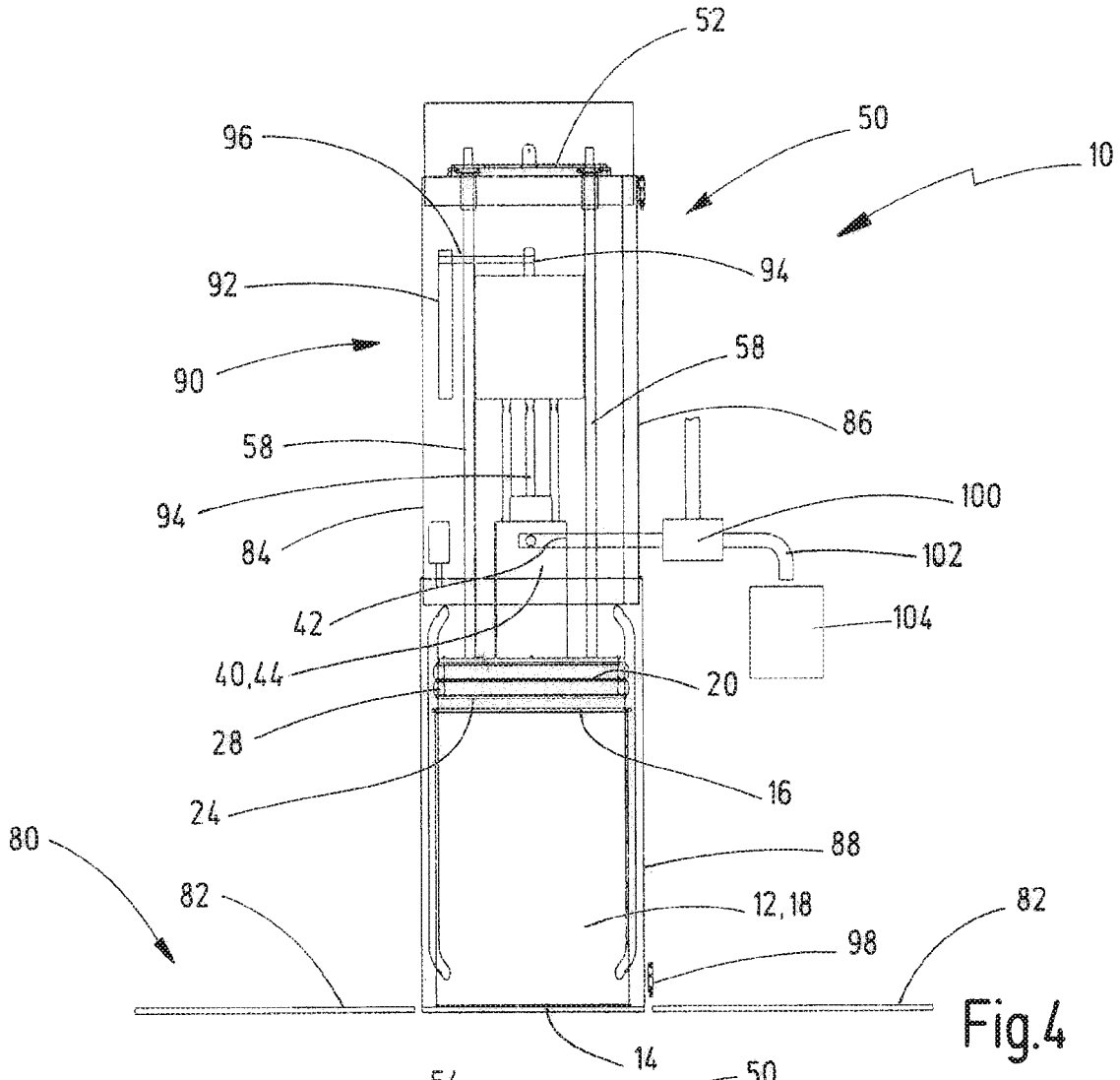
FIGS. 4, 5 show an apparatus for the conveying of viscous material in front view and in overhead view.

At the beginning of a conveying process, the follower plate 20 is situated in the position illustrated in FIG. 2*a*, in which its underside 24 rests on the surface of the material in the filled container 12. The contacting part 34 is situated in its sealed position, so that the wiper ring 28 seals the container interior space 38 from the surroundings. If material is being conveyed out of the container 12, the material level descends and the follower plate 20 is moved downward in the container 12 by means of the lifting device in a manner following the material level, wherein the contacting part 34 slides over the inside face 36 with overcoming of a frictional force and wipes off material adhering to this. Once the container has been completely emptied, the follower plate 20 is situated on the container bottom 14, as illustrated in FIG. 2*b*, wherein a thin material film possibly still remains between the follower plate 20 and the container bottom 14. After the emptying of the container 12, compressed air is injected into the dome 22, so that the follower plate 20 is raised from the container bottom 14. Simultaneously with the injection of compressed air into the dome 22, or a short time later, the force pressing the contacting part 34 against the inside face 36 is removed by release of compressed air from the cavity 30, so that the contacting part 34 is retracted from the inside face 36. The contacting part 34 is then situated in a released position, in which the sealing effect between the container interior space 38 and the surroundings is nullified. By means of the lifting device, the follower plate 20 is then lifted out of the container 12, until it is situated once again in the position illustrated in FIG. 1. The empty container 12 may then be replaced by a new, full container and the conveying process may begin anew.

At the material outlet 26 of the follower plate 20, a conveyor pump 40 connected in fixed manner to the follower plate 20 is attached in order to convey material from the container 12 via the material outlet 26 into a conveying line 42 leading to a processing station. The conveyor pump 40 has a conveyor cylinder 44 mounted in fixed manner on the follower plate 20 as well as a conveyor piston, not illustrated in the drawing, which can be moved forward and back in the conveyor cylinder 44, and the linear movement of which in the conveyor cylinder 44 sucks material through the material outlet 26 into the conveyor cylinder 44 and forces the material out of the conveyor cylinder 44 into the conveying line 42.

Since, by virtue of the variable diameter of the wiper ring 28, the follower plate 20 may be introduced almost contactlessly and without force exertion into the container 12 during a container replacement, a lifting device 50, on which a horizontally oriented crosspiece 52 in the form of a metal plate is mounted with its first end 54, while its second end 56 is free, is provided in the conveyor apparatus 10 according to the invention. From the crosspiece 52, two retaining rods 58, which carry the follower plate 20, extend vertically downward. The lifting device 50 is provided with a spindle drive, not shown in more detail, driven by means of an electric motor, for raising and lowering of the crosspiece 52.

The conveyor apparatus 10 is additionally provided with a transport device 80, which has a roller track 82, with which the container 12 can be transported in a direction perpendicular to the longitudinal extent of the crosspiece 52. In this way, emptied containers 12 may be transported away from the follower plate 20 and full containers 12 may be transported underneath the follower plate 20. In addition, a housing 84 is provided, which annularly surrounds the container 12 and the follower plate 20 during the introduction of the follower plate 20 into the container 12 as well as during the conveying of the material. The housing 84 is provided with two transparent sliding doors 86, 88, which are disposed one above the other and respectively annularly surround an interior space, and which annularly surround the container 12, the follower plate 20 and the conveyor pump 40 during operation for minimization of the danger of injury to operator control personnel. In order that the conveyor pump 40 may be accessed, the upper sliding door 86 can be displaced downward, whereas the lower sliding door 88 can be displaced upward, to permit a container replacement. In addition, a control device is provided, with which a filled container 12 is positioned completely automatically underneath the follower plate 20 by means of feed movement on the roller track 82, with which the follower plate 20 is automatically introduced into the container 12, with which the follower plate 20, after the emptying of the container 12, is automatically removed from this, and with which the emptied container 12 is automatically transported away by means of the transport device 80. A sensor 98 recognizes the correct positioning of the container 12 underneath the follower plate 20.

Figure 5:
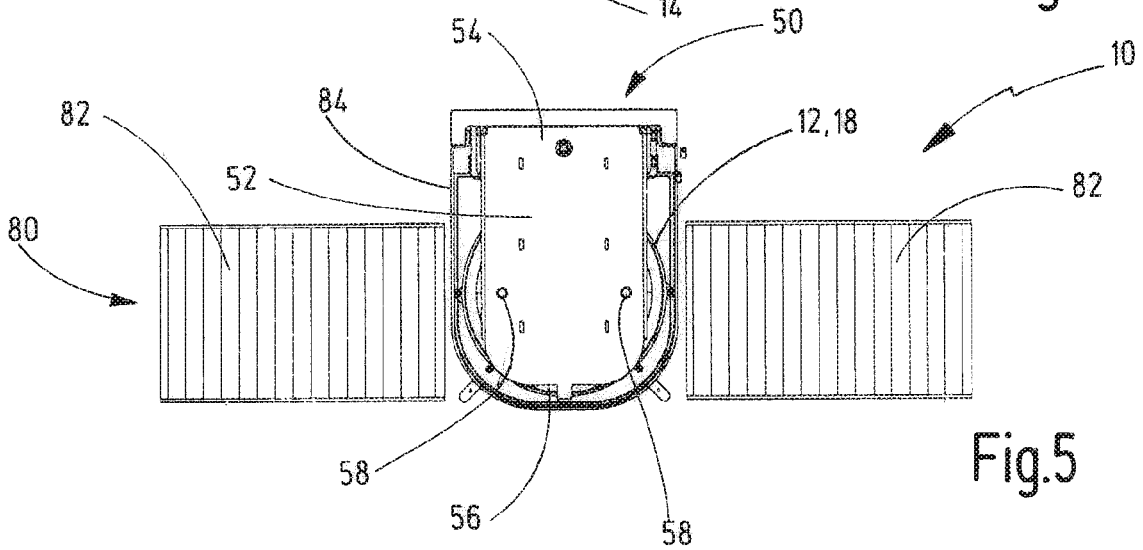

The conveyor apparatus 10 additionally has a measuring device 90, with which the speed of the conveyor piston during the delivery stroke may be measured. The measuring device 90 has a distance-measuring unit in the form of an absolute-value transmitter 92, the housing of which is mounted on the lifting device 50. A piston rod 94 connected in fixed manner to the conveyor piston is guided upwardly out of the conveyor cylinder 44 and by means of connecting rods 96 is connected rigidly to a movable element of the absolute-value transmitter 92. The distance-measuring device 90 additionally has a control unit, not illustrated in more detail, which controls the conveying of the viscous material in dependence on the measured speed of the conveyor piston. The control unit recognizes when the measured speed of the conveyor piston lies outside a tolerance range by a predesignated target speed, which suggests that the consistency of the material being conveyed has changed so much that its suitability is in question. In this case, the control unit operates a valve 100, so that the material being conveyed is conveyed not to the processing station but instead into a waste line 102, which is branched off from the conveying line 42 and leads to a waste container 104. If the control unit recognizes that the speed of the conveyor piston again lies within the tolerance range, it operates the valve 100 yet again and the viscous material is again conveyed via the conveying line 42 to the processing station. The measuring device 90 is intended in particular to prevent material permeated with air bubbles from being conveyed. It can be used in particular when the follower plate 20 has been introduced into a full container 12, in order to convey material in an automatic process into the waste container 104 until this no longer includes any air bubbles. However, it may also be used during the conveying process and detect the air bubbles present in the material in order to convey the material permeated with air bubbles into the waste container 104 instead of to the processing station. In FIG. 5, the illustration of the measuring device 90, of the valve 100, of the waste line 102 and of the waste container 104 has been omitted for the sake of clarity.

In summary, the following is to be stated: The invention relates to an apparatus 10 for the conveying of viscous material from a drum-like container 12, which has a container bottom 14 and a circumferential container wall 18, extending from the container bottom 14 to a container upper side 16 and is open at the container upper side 16, with, for closing of the container 12, a follower plate 20 having a material outlet 26 attached to a conveyor pump 40, wherein the follower plate 20 is provided with an annularly circumferential wiper ring 28, wherein the wiper ring 28 has a radially outwardly extending contacting part 34 for contact against an inside face 36, turned toward the follower plate 20, of the container wall 18, and wherein the contacting part 34 can be pressurized with a variable pressing force for pressing against the inside face 36 of the container wall 18. According to the invention, it is provided that the follower plate 20 is mounted by means of at least one vertically extending retaining rod 58 on a horizontally extending crosspiece 52, which is mounted on or close to a first end 54 on a lifting device 50 for raising and lowering of the crosspiece 52, while its second end 56 is free.

The invention claimed is:

1. An apparatus for conveying viscous material from a drum-like container, which has a container bottom and a circumferential container wall extending from the container bottom to a container upper side and is open at the container upper side, with, for closing of the container, a follower plate having a material outlet attached to a conveyor pump, wherein the follower plate is provided with an annularly circumferential wiper ring, wherein the wiper ring has a radially outwardly extending contacting part for contact against an inside face, turned toward the follower plate, of the circumferential container wall, wherein the contacting part can be pressurized with a variable pressing force for pressing against the inside face of the circumferential container wall, wherein the follower plate is mounted by at least one vertically extending retaining rod on a horizontally extending crosspiece, which is mounted on or close to a first end on a lifting device for raising and lowering of the crosspiece, while its a second end of the crosspiece is free, and wherein the lifting device has at least one guide rod that is connected in fixed manner to the crosspiece and is linearly movable in a guide in vertical direction as well as a drive unit for raising and lowering of the crosspiece.

2. The apparatus according to claim 1, wherein each guide rod is linearly movable in a tubular guide and has a first guide element bearing on an inside face of the guide at or close to a lower end, while the guide has a positionally fixed second guide element bearing on an outside face of the guide rod at or close to an upper end.

3. The apparatus according to claim 1, wherein the lifting device has two guide rods extending parallel to one another and two guides extending parallel to one another.

4. The apparatus according to claim 1, wherein the lifting device is provided with a spindle drive for raising and lowering of the crosspiece.

5. The apparatus according to claim 1, wherein the contacting part can be retracted from the inside face of the circumferential container wall by reduction of the pressing force.

6. The apparatus according to claim 1, wherein the wiper ring is hollow and has an outer wall enclosing a cavity that is at least partly annularly circumferential and that can be filled with a pressurized medium.

7. The apparatus according to claim 6, wherein the outer wall is thicker in a region of the contacting part than in other regions of the outer wall.

8. The apparatus according to claim 6, comprising a device for injection of the pressurized medium into the cavity and for removal from the cavity.

9. The apparatus according to claim 8, wherein the contacting part, by pressurization of the cavity with two predetermined different pressures, is movable between a sealed position, in which the contacting part bears sealingly against the inside face of the circumferential container wall and a released position, in which a sealing effect with the inside face of the circumferential container wall is nullified.

10. The apparatus according to claim 1, wherein the follower plate is provided with at least one further wiper ring, which is structurally identical to and is disposed parallel to and at a spacing from the wiper ring.

11. The apparatus according to claim 1, wherein the conveyor pump has a conveyor cylinder and a conveyor piston that can be moved forward and back in the conveyor cylinder (44), and wherein a measuring device is provided for measurement of the speed of the conveyor piston.

12. The apparatus according to claim 11, wherein the measuring device has a distance-measuring unit for time-dependent measurement of a distance traveled by the conveyor piston.

13. The apparatus according to claim 12, wherein the conveyor piston is connected mechanically to the distance-measuring unit.

14. The apparatus according to claim 13, wherein the conveyor pump has a piston rod, which projects from the conveyor cylinder, is connected to the conveyor piston, and is connected rigidly by way of a connector to the distance-measuring unit.

15. The apparatus according to claim 12, wherein the distance-measuring unit is an absolute-value transmitter.

16. The apparatus according to claim 11, wherein the measuring device has a control unit for control of the conveying of the viscous material in dependence on a measured speed of the conveyor piston.

17. The apparatus according to claim 16, wherein a waste line leading to a waste container is branched off from a conveying line, attached to the conveyor pump, for the viscous material, and the conveying line can be blocked and the waste line released by the control unit.

18. A method for conveying of viscous material from a drum-like container, which has a container bottom and a circumferential container wall, extending from the container bottom to a container upper side, which is open at the container upper side, the method comprising:

providing an apparatus comprising a follower plate having a material outlet attached to a conveyor pump, wherein the follower plate is provided with an annularly circumferential wiper ring, wherein the wiper ring has a radially outwardly extending contacting part for contact against an inside face, turned toward the follower plate, of the circumferential container wall, and wherein the contacting part can be pressurized with a variable pressing force for pressing against the inside face of the circumferential container wall, wherein the follower plate is mounted by at least one vertically extending retaining rod on a horizontally extending crosspiece, which is mounted on or close to a first end on a lifting device for raising and lowering of the crosspiece, while a second end of the crosspiece is free;

moving the follower plate in the direction of the container bottom by following a descending material level in a manner resting on a surface of the material and, after emptying of the container, is moved moving the follower plate away from the container bottom;

pressing the wiper ring, during the movement of the follower plate to the container bottom, sealingly with the contacting part of the wiper ring against the inside face of the circumferential container wall and, during the movement of the follower plate away from the container bottom, a sealing effect between the wiper ring and the circumferential container wall is nullified by reduction of the pressing force;

wherein, using a control device, the emptied container is automatically transported away after removal of the follower plate; and wherein, using the control device, a container filled with the viscous material is positioned underneath the follower plate.

19. The method according to claim 18, wherein, for raising of the follower plate after emptying of the container, compressed air is injected into a region between the follower plate and the container bottom, before the sealing effect between the wiper ring and the circumferential container wall is nullified.

20. The method according to claim 18, wherein after replacement of the emptied container by the filled container, material is conveyed via a waste line into a waste container until the measured speed of the conveyor piston lies in a predetermined tolerance range around a predetermined target speed.

21. An apparatus for conveying viscous material from a drum-like container, which has a container bottom and a circumferential container wall extending from the container bottom to a container upper side and is open at the container upper side, with, for closing of the container, a follower plate having a material outlet attached to a conveyor pump, wherein the follower plate is provided with an annularly circumferential wiper ring, wherein the wiper ring has a radially outwardly extending contacting part for contact against an inside face, turned toward the follower plate, of the circumferential container wall, wherein the contacting part can be pressurized with a variable pressing force for pressing against the inside face of the circumferential container wall, wherein the follower plate is mounted by at least one vertically extending retaining rod on a horizontally extending crosspiece, which is mounted on or close to a first end on a lifting device for raising and lowering of the crosspiece, while a second end of the crosspiece is free, and wherein the apparatus comprises a transport device for transporting of the container in a direction perpendicular to a longitudinal extent of the crosspiece.

22. The apparatus according to claim 21, wherein the transport device has a roller track, on which the container is installed.

23. An apparatus for conveying viscous material from a drum-like container, which has a container bottom and a circumferential container wall extending from the container bottom to a container upper side and is open at the container upper side, with, for closing of the container, a follower plate having a material outlet attached to a conveyor pump, wherein the follower plate is provided with an annularly circumferential wiper ring, wherein the wiper ring has a radially outwardly extending contacting part for contact against an inside face, turned toward the follower plate, of the circumferential container wall, wherein the contacting part can be pressurized with a variable pressing force for pressing against the inside face of the circumferential container wall, wherein the follower plate is mounted by at least one vertically extending retaining rod on a horizontally extending crosspiece, which is mounted on or close to a first end on a lifting device for raising and lowering of the crosspiece, while a second end of the crosspiece is free, and wherein the apparatus comprises a housing that annularly surrounds the container and the follower plate and is provided with at least one door.

24. The apparatus according to claim 23, comprising a control device for automatic positioning of the container underneath the follower plate by the transport device, for automatic introduction of the follower plate into the container, for automatic removal of the follower plate (20) from the container after emptying the container and for automatic transportation away of the container by the transport device.

* * * * *